US008960314B2

(12) United States Patent
Ramon et al.

(10) Patent No.: US 8,960,314 B2
(45) Date of Patent: Feb. 24, 2015

(54) SHAPE MEMORY SEAL ASSEMBLY

(75) Inventors: Michael Ramon, Houston, TX (US); Mark Adam, Houston, TX (US); Edward Wood, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 361 days.

(21) Appl. No.: 13/430,969

(22) Filed: Mar. 27, 2012

(65) Prior Publication Data

US 2013/0256991 A1 Oct. 3, 2013

(51) Int. Cl.
*E21B 33/12* (2006.01)
*E21B 33/128* (2006.01)

(52) U.S. Cl.
CPC ..... *E21B 33/12* (2013.01); *E21B 33/1208* (2013.01); *E21B 33/1285* (2013.01)
USPC ..... 166/387; 166/179

(58) Field of Classification Search
CPC ..... E21B 33/00; E21B 33/10; E21B 33/1208
USPC ..... 166/387, 179, 180; 277/336, 323
See application file for complete search history.

(56) References Cited

U.S. PATENT DOCUMENTS

| | | | | |
|---|---|---|---|---|
| 5,568,836 | A | 10/1996 | Reid | |
| 7,428,928 | B2 * | 9/2008 | Cho et al. | 166/285 |
| 7,690,437 | B2 * | 4/2010 | Guillot et al. | 166/387 |
| 7,743,825 | B2 | 6/2010 | O'Malley et al. | |
| 7,743,835 | B2 * | 6/2010 | Willauer | 166/387 |
| 2005/0072579 | A1 * | 4/2005 | Gambier | 166/387 |
| 2008/0264647 | A1 | 10/2008 | Li | |
| 2008/0296014 | A1 | 12/2008 | Richard et al. | |
| 2010/0078173 | A1 * | 4/2010 | Buytaert et al. | 166/302 |
| 2010/0126735 | A1 * | 5/2010 | Allison et al. | 166/387 |
| 2010/0236794 | A1 * | 9/2010 | Duan et al. | 166/387 |
| 2010/0294485 | A1 * | 11/2010 | Lynde | 166/179 |
| 2011/0259587 | A1 | 10/2011 | Joseph et al. | |
| 2012/0175845 | A1 * | 7/2012 | Duan et al. | 277/314 |
| 2012/0273199 | A1 * | 11/2012 | Cresswell et al. | 166/285 |
| 2012/0305253 | A1 * | 12/2012 | O'Malley | 166/302 |
| 2013/0048289 | A1 * | 2/2013 | Mazyar et al. | 166/304 |
| 2013/0220644 | A1 * | 8/2013 | Fripp et al. | 166/387 |
| 2013/0277068 | A1 * | 10/2013 | Richard | 166/387 |
| 2014/0041858 | A1 * | 2/2014 | Sun et al. | 166/179 |

FOREIGN PATENT DOCUMENTS

WO 2007/103680 A1 9/2007

OTHER PUBLICATIONS

Spira International, [online]; [retrieved on Apr. 19, 2012]; retrieved from the Internet http://spiraengineering.com/ ha_sealoil.html, "Sealing Oilfield Valves and Down-Hole Oil Tools," Spira Engineering Technical Articles, 2p.

International Search Report, International Application No. PCT/US2013/026854; Korean Intellectual Property Office; Date of Mailing May 30, 2013, pp. 1-3.

* cited by examiner

*Primary Examiner* — Kenneth L Thompson
(74) *Attorney, Agent, or Firm* — Cantor Colburn LLP

(57) ABSTRACT

A sealing assembly including a seal element at least partially formed from a shape memory material. The shape memory material urges the seal element to revert to an original shape upon exposure to a transition stimulus. The seal element is operatively arranged for sealing against a downhole structure when in the original shape. An interlock mechanism is included for holding the seal element in a deformed position in which the seal element is not able to seal against the downhole structure even after exposure to the transition stimulus. A method of setting a downhole sealing assembly is also included.

35 Claims, 6 Drawing Sheets

SHAPE MEMORY SEAL ASSEMBLY

BACKGROUND

Seals are ubiquitous in the downhole drilling and completions industry. With respect to packers and other seal assemblies, it is often required for a seal element to be run-in with a reduced radial dimension and then radially enlarged for forming a sealed engagement. One such type of sealing assembly involves axially compressing an elastomeric seal element in order to displace the material of the seal element radially outward. While this type of seal assembly does generally work, these seals can in some situations buckle, twist, and wrinkle, which can result in complicated leak paths through the seal element, particularly if the seal element must be compressed a large axial distance. Due to the limitations of these and other systems, alternatives in sealing systems are always well received by the industry.

SUMMARY

A sealing assembly including a seal element at least partially formed from a shape memory material, the shape memory material urging the seal element to revert to an original shape upon exposure to a transition stimulus, the seal element operatively arranged for sealing against a downhole structure when in the original shape; and an interlock mechanism for holding the seal element in a deformed position in which the seal element is not able to seal against the downhole structure even after exposure to the transition stimulus.

A method of setting a downhole sealing assembly including positioning a seal element in a borehole, the seal element having a deformed shape during positioning of the seal element and formed at least partially from a shape memory material for urging the seal element to an original shape upon exposure to a transition stimulus; exposing the seal element to the transition stimulus for urging the shape memory material to revert the seal element to the original shape; preventing a transition of the seal element from the deformed shape to the original shape with an interlock coupled to the seal element; and releasing the interlock for enabling the seal element to return to its original shape.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
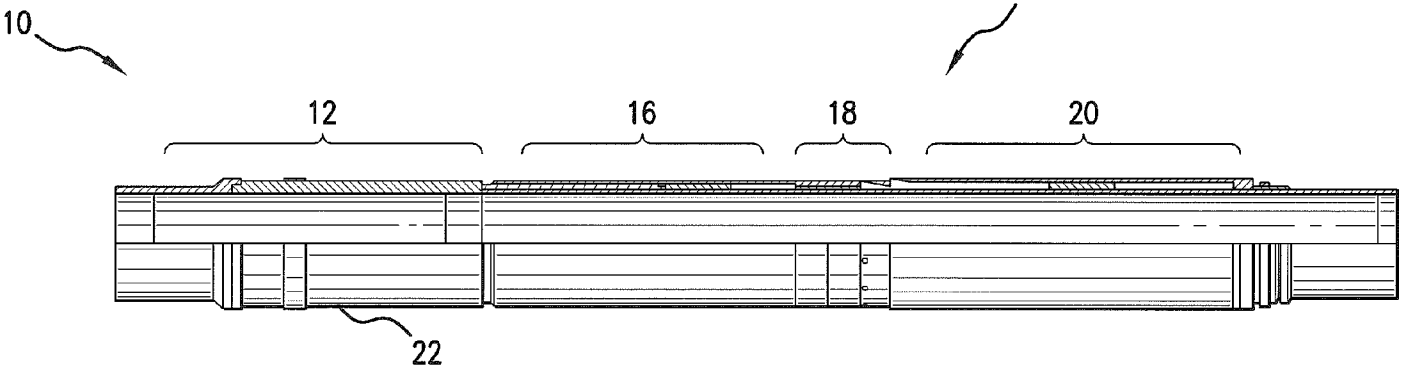
FIG. 1 is a quarter-sectional view of a seal system according to one embodiment described herein.
Figure 2B:
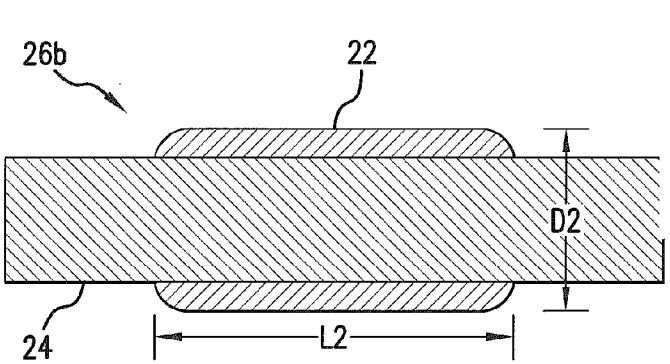
FIGS. 2A and 2B schematically show a seal element in an original shape and a deformed shape suitable for run-in, respectively.
Figure 2A:
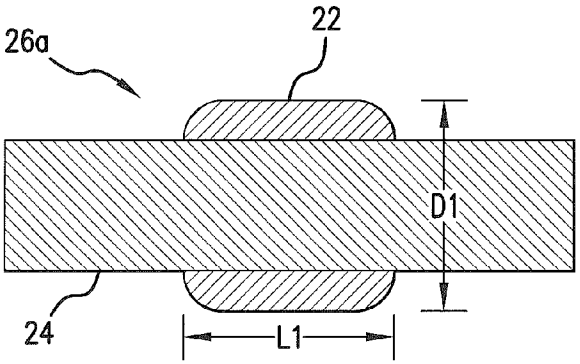

Referring now to FIG. 1, a system 10 is schematically illustrated having a seal sub 12 and a control sub 14. In one embodiment the system 10 is a packer system for enabling isolation in a downhole structure (e.g., a casing, liner, open borehole, etc.). In the illustrated embodiment, the control sub 14 includes a setting assembly 16, a timer 18, and a fluid pressure sub 20 discussed in more detail below. The seal sub 12 includes a seal element 22 that has shape memory properties, e.g., a shape memory polymer. That is, as shown in FIGS. 2A and 2B, the seal element 22 is installed on a tubular 24 and has a repositionable or redistributable volume that enables the seal element 22 to transition between an original shape 26*a* and a deformed shape 26*b*.

The shape 26*a* is the default, permanent or original shape into which the seal element 22 reverts after being exposed to a triggering stimulus (e.g., temperature, light, electrical current, magnetic field, pH, etc.). For example, the seal element 22 taking the form of a shape memory polymer may transition to the original position 26*a* once a temperature of the seal element 22 raises above the glass transition temperature (Tg), the melting temperature (Tm), etc., (collectively, the transition temperature) of a shape memory material at least partially forming the seal element 22. The deformed shape 26*b* is arranged, for example, to facilitate some task or operation that requires the seal element 22 to have a reduced dimension, such as the installation of the seal element 22, the running-in of tubular 24 (or a string including the tubular 24), etc. In the illustrated embodiment, the volume of the seal element 22 is repositionable such that the original shape 26*a* has a first radial dimension R1 that is greater than a second radial dimension R2 of the shape 26*b* and a first longitudinal dimension L1 that is less than a second longitudinal dimension L2 of the shape 26*b*. In this way, the seal element 22 is initially radially compressed so that it can be run-in, e.g., through radially restricted areas, without incident, and radially expandable thereafter to the original shape 26*a* to fill an annulus and seal the tubular 24 with respect to a radially disposed downhole structure. Advantageously, the use of shape memory material in the seal element 22 also enables the seal element 22 to more accurately conform to the particular structure against which it is arranged to seal. For example, use of shape memory material will enable the seal element 22 to effectively seal against a variety of jagged, rough, uneven or otherwise irregular surfaces, such as in open sections of a borehole.

As noted above, the seal element 22 can be held in the deformed position 26*b*, e.g., by lowering the temperature of the seal element 22 below its glass transition temperature or by otherwise removing exposure of the seal element 22 to its corresponding transition stimulus. For ease of discussion herein, when the threshold value for the triggering parameter is not met the seal element 22 may be described as "frozen" even if the transition stimulus for the seal element 22 is not temperature (e.g., as noted above, the shape memory materials, shape memory polymers in particular, can also be stimulated by light, magnetism, electricity, etc.).

Figure 3A:
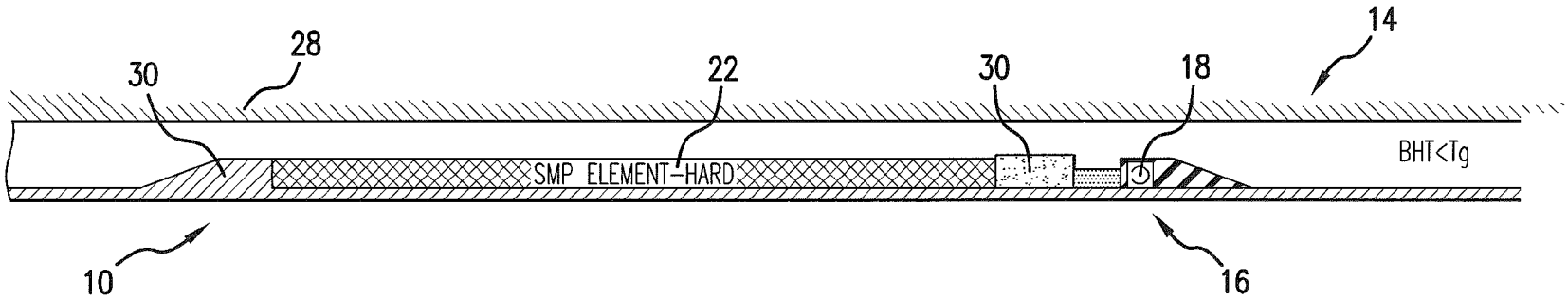
FIGS. 3A-3D schematically show a seal system being deployed and set in a borehole.
Figure 3B:
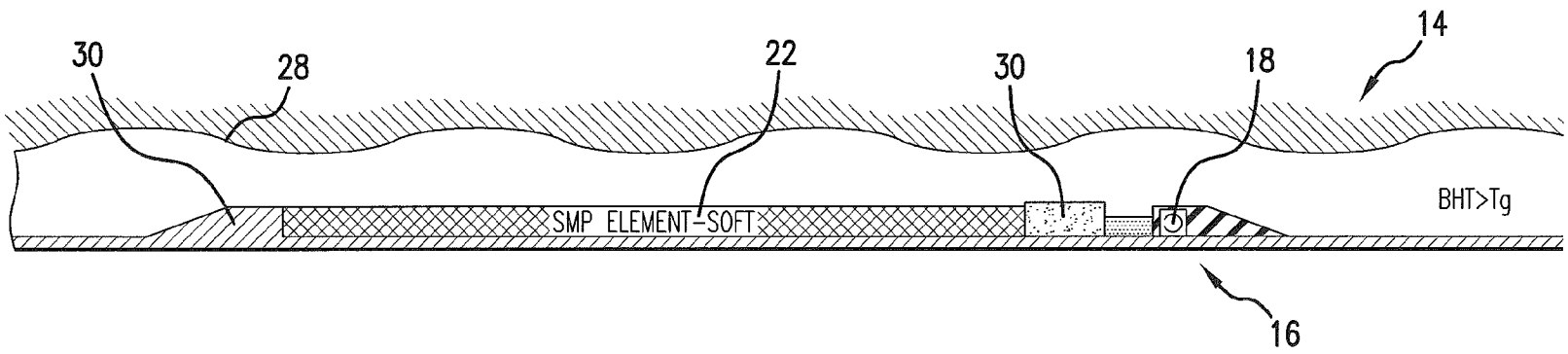

In general, the system 10 is intended to form a seal for a tubular string run in a downhole environment. For example, FIG. 3A shows the system 10 being run into a borehole 28, with the seal element 22 initially frozen, i.e., the seal element 22 is not yet exposed to its corresponding transition stimulus (e.g., the borehole temperature is greater than the Tg of the seal element 22). Again, in other embodiments, the seal element 22 could be initially frozen in its deformed or run-in shape, e.g., the shape 26*b*, due to stimuli other than high temperatures. In FIG. 3B, the system 10 is positioned in the borehole 28 at a location where isolation is desired. In the illustrated embodiment, the location is an open section of the borehole 28, although it is to be appreciated that the system 10 could be similarly positioned in a cased or lined section or other downhole structure.

At the location desired for isolation, the seal element 22 is exposed to the transition stimulus, e.g., the downhole temperature exceeds the glass transition temperature of the seal element 22. However, an interlock (discussed in more detail below) of the control sub 14 is arranged to at least temporarily prevent the setting assembly 16 from extending thereby also preventing the seal element 22 from reverting to its original shape. That is, the setting assembly 16 is secured to the seal element 22 via at least one retaining ring or cap 30, which are located at opposite ends of the seal element 22. In various embodiments, the retaining rings 30 may be secured to the seal element 22 in any suitable way, such as adhesives, bolts, pins, compressive forces, etc., and coupled to the setting assembly 16 mechanically, hydraulically, etc. In one embodiment, the timer 18 is coupled with the interlock for releasing the interlock only at a predetermined time, after a predetermined amount of time elapses, or after a predetermined event occurs, as discussed in more detail below. In this way, the seal element 22 does not instantly begin to revert to its original shape and isolation does not automatically occur upon exposing the seal element 22 to its transition stimulus. In this way, other downhole operations can be commenced before isolation is achieved, e.g., pressurizing the borehole and/or tubular string further downhole, circulation or fluid communication between opposite axial sides of the seal sub 12, etc.

Figure 3C:
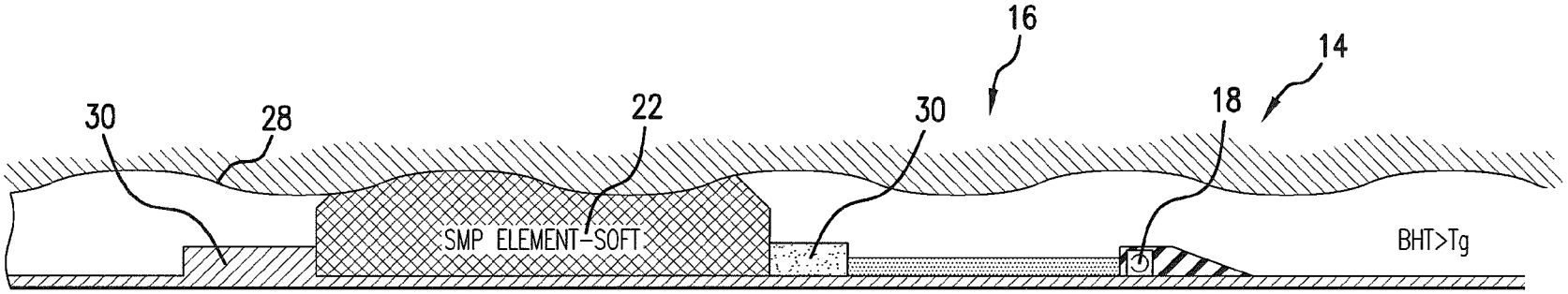

After positioning the system 10 and performing any additional desired downhole operations, the control sub 14 is triggered, e.g., via the timer 18, for releasing the interlock and enabling the seal element 22 to revert to its original shape, as shown in FIG. 3C. The release of the interlock and return of the seal element 22 to its original shape can be assisted by a compressive load supplied by the setting assembly 16, which can, e.g., take the form of a piston or other actuator that is actuatable by some mechanical, hydraulic, electric, magnetic, etc., source. For example, the fluid pressure sub 20 could be a nitrogen charge or similar device including a highly pressurized fluid for actuating a piston or the like. Any device suitable for enabling proper timing of the release of the interlock could be used as or with the timer 18. For example, any type of downhole clock, timer, delay, counter, etc. could be used for the timer 18. In one embodiment the timer 18 is a programmable clock or countdown type timer that is set or programmed at the surface before running the system 10, which enables release of the interlock after the passage of a certain amount of time. In another embodiment, the timer 18 is, or includes, a sensor to trigger release of the interlock upon detection of some downhole parameter or condition, e.g., pressure, temperature, vibration, sound, magnetic field, etc. In this way, the timer 18 enables proper timing, for example, by requiring some event or condition, e.g., as evidenced by a measurable parameter, to occur before release of the interlock. The event or condition could be naturally occurring, or be one that is set by operators at the surface, e.g., by pumping fluids downhole, dropping an object such as a magnetic or RFID enabled dart, triggering a mechanism via an electronic signal, etc. Of course, any combination of the above could be included, e.g., a programmable clock that enables release of the interlock after the passage of a pre-set amount of time, where counting down only begins upon first detecting a corresponding parameter or condition.

Figure 3D:
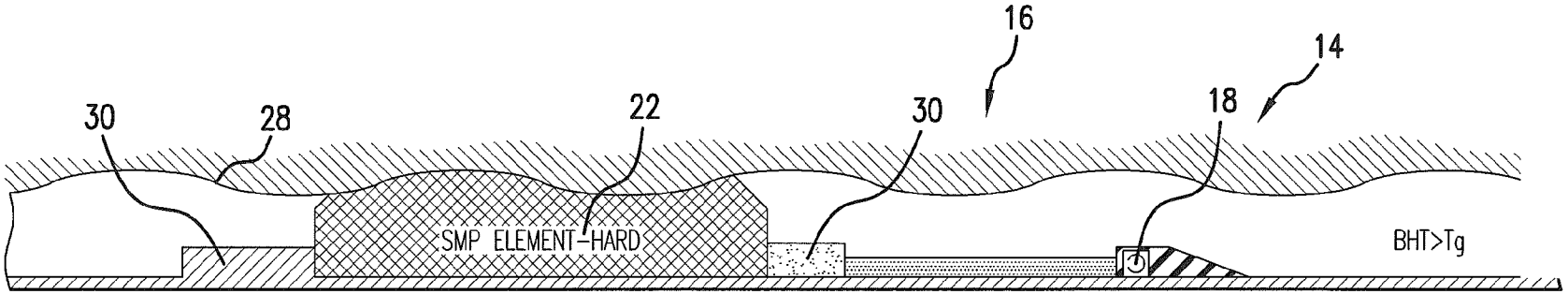

In a further embodiment illustrated in FIG. 3D, the downhole conditions are set in order to remove the transition stimulus and re-freeze the seal element 22 in its set position. By re-freezing the seal element 22, the properties of the seal element 22 will change, e.g., the seal will become more rigid, which will increase the pressure rating of the seal formed by the seal element 22. Advantageously, it is also noted that in the case the seal element 22 is sealed against an irregular downhole structure, e.g., an open section of a borehole, the seal element 22 can be hardened and/or frozen in the particular shape of the downhole structure. In embodiments in which temperature is the transition stimulus, for example, the temperature downhole will be significantly reduced in water injection wells, during fracing operations, etc., when relatively cold fluids are pumped downhole, and this change in temperature can be used to add rigidity to the seal element 22. As another example using temperature as the transition stimulus, the seal element 22 in a steam-assisted gravity drainage (SAGD) system can be set such that the seal element 22 is frozen in ambient downhole conditions and only begins to return to its original form when hot steam is pumped downhole. In this example, the seal element 22 can be reshaped simultaneously with the pumping of steam downhole, and allowed to re-freeze or harden when the steam is no longer being pumped.

Figure 4:
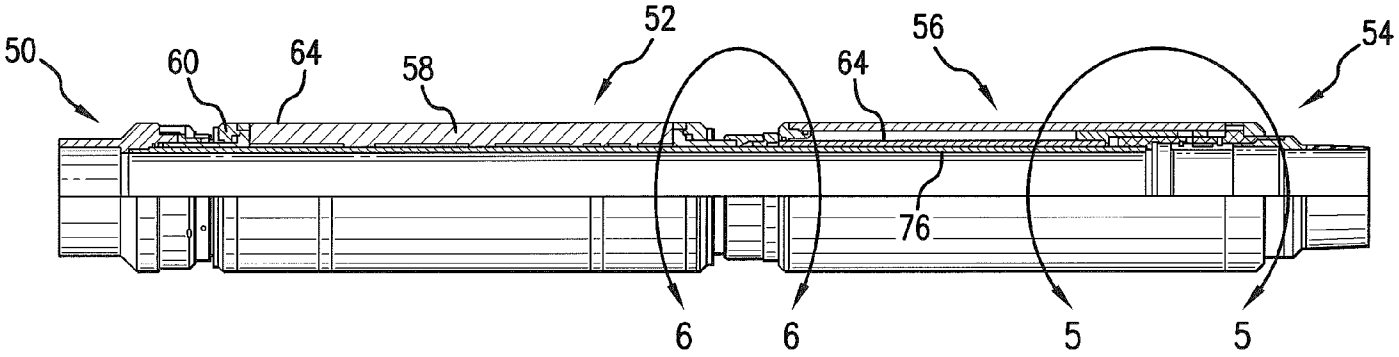
FIG. 4 is a quarter-sectional view of a setting assembly for a seal system according to one embodiment described herein.
Figure 5:
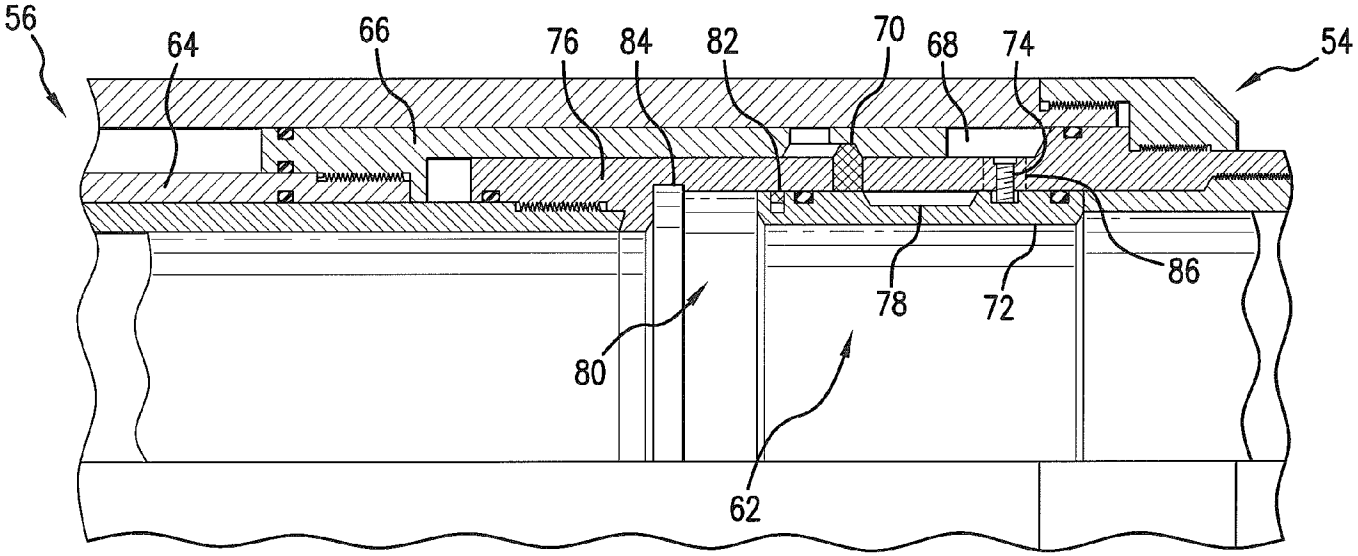
FIG. 5 is an enlarged view of the area designated 5-5 and encircled in FIG. 4.
Figure 6:
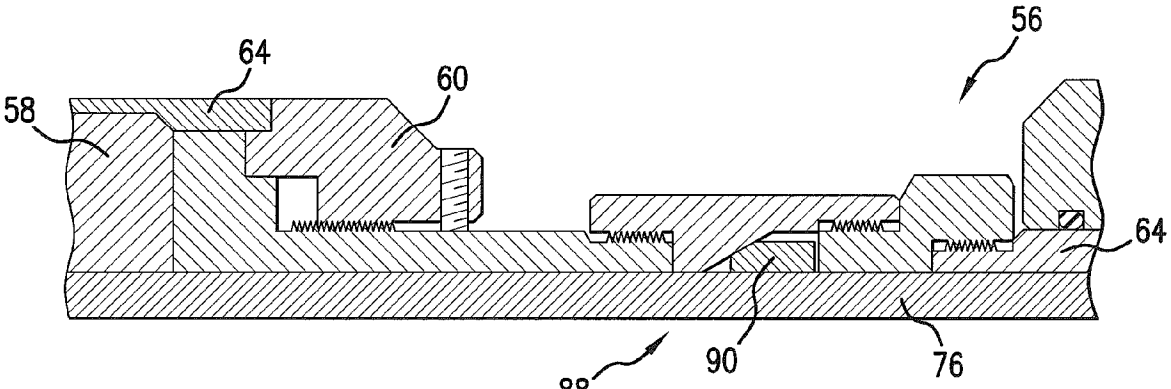
FIG. 6 is an enlarged view of the area designated 6-6 and encircled in FIG. 4.

A system 50 is illustrated in FIGS. 4-6 in order to provide one example of some of the structures discussed with respect to, but not specifically illustrated for the system 10 (e.g., details of the setting assembly 16, the interlock, etc.) Thus, any general description given above with respect to the system 10 applies to similarly named components of the system 50, unless otherwise stated. For example, the system 50 includes a seal sub 52 and a control sub 54 and could be similarly run, positioned, and set as described with respect to the system 10 in FIGS. 3A-3D.

The control sub 54 has a setting assembly 56 for assisting in transition of a seal element 58 of the seal sub between a deformed or run-in shape (e.g., as shown in FIG. 4 and/or resembling the shape 26*b*) to an original shape (e.g., resembling the shape 26*a*). The seal element 58 is held at opposite ends by a pair of retaining members 60. Each of the members 60 includes a ring or tube 64 that radially covers the seal element 58 and enables the members 60 to be adhered, affixed, fastened, or otherwise secured to the seal element 58. The members 60 are movable with respect to each other, as discussed in more detail below, for enabling the seal element 58 to transition from its deformed or run-in shape to its original shape upon exposure to the transition stimulus of the shape memory material of the seal element 58.

The setting assembly 56 is initially locked by an interlock 62 and includes a connector 64 extending between a corresponding one of the members 60 and a piston 66. The piston 66 is actuatable in a chamber 68, but initially locked by the interlock 62. In the illustrated embodiment, the interlock 62 includes a dog 70, shown in more detail in the enlarged view of FIG. 5. The dog 70 is initially radially supported by a sleeve 72, which is held in place by a release member 74. In the illustrated embodiment, the release member 74 is a shear screw connecting the sleeve 72 to a mandrel 76, although other release members, e.g., collets, shear rings, etc., could be used. The sleeve 72 is displaceable, e.g., by exerting a force on the sleeve 72 sufficiently high for releasing the release member 74 (e.g., shearing a shear screw or ring, releasing a collet, etc.). The force necessary to release the release member 74 can be accomplished by fluid pressure, a shifting tool, etc. (e.g., the fluid pressure sub 20, a magnetic or RFID enabled plug or dart, a hydraulic pressure enabled by a plug landing at a seat, an electrically driven actuator, etc.) and triggered at an appropriate time by a timer mechanism (e.g., the timer 18 as discussed above).

Once the sleeve 72 is shifted, a recess 78 in the sleeve 72 becomes axially aligned with the dog 70 and enables the dog 70 to shift radially outwardly. Shifting the dog 70 radially outwardly releases the interlock 62, thereby releasing the piston 66 and the connector 64, such that the seal element 58 is able to revert to its original shape when exposed to its transition stimulus. A locking mechanism 80 can be included with the sleeve 72 for maintaining the sleeve 72 in its shifted position. In the illustrated embodiment, the locking mechanism takes the form of a radially resilient split ring 82 that springs radially outwardly into a recess 84 in the mandrel 76 for partially radially overlapping both the sleeve 72 and the recess 84 and restricting relative movement therebetween.

In the illustrated embodiment, a port 86 is included in the mandrel 76 in order to provide fluid communication into the chamber 68. In the illustrated embodiment the port 86 is longitudinally aligned with and rotationally offset from the release member 74, although other locations are also possible. The port 86 enables a fluid pressure to act against and the piston 66 in order to urge the piston 66 toward the seal element 58. In this way, the seal element 58 can be set by not only passively by the shape memory material urging the seal element 58 toward its original shape, but by additionally pressuring against the piston 66 to assist in longitudinally compressing and radially expanding the seal element 58. Of course, it is to be appreciated that the piston 66 is not required in some embodiments for the seal element 58 to revert to its original shape and properly seal against a downhole structure.

In one embodiment, the dog 70 is made from a material that is dissolvable, corrodible, degradable, consumable, or otherwise removable in response to one or more downhole fluids, either naturally occurring or pumped or delivered to the dog 70. For example, shifting of the sleeve 72 could open the port 86, thereby exposing the dog 70 to a suitable fluid, such as a brine, acid, etc. In this way, the dog 70 can be chemically removed instead of radially displaced in order to release the interlock and enable the seal element 58 to transition back to its original shape. For example, the dog 70 could be made from highly reactive materials such as magnesium, aluminum, or a controlled electrolytic metallic material, as used in products sold commercially by Baker Hughes, Inc. under the tradename IN-TALLIC®, which would enable the degradation, corrosion, or removal of the dog 70 to be predictably tailored in response to various downhole fluids.

A lock mechanism 88 for maintaining the seal element 58 in the set position is shown in more detail in FIG. 6. For example, the lock mechanism 88 is illustrated as including a ratchet or body lock ring 90 in FIG. 6, which permits movement of the setting assembly 56 in one direction only, i.e., toward the seal element 58 for setting the seal element 58. Thus, as the seal element 58 is set, the lock mechanism 88 will maintain the set configuration of the seal element 58. It is to be appreciated that other lock mechanisms could be included, e.g., resembling the split ring 82 that drops into the groove 84, as discussed above. Likewise, the split ring 82 could be replaced by a ratcheting device, body lock ring, or some other component.

Figure 7A:
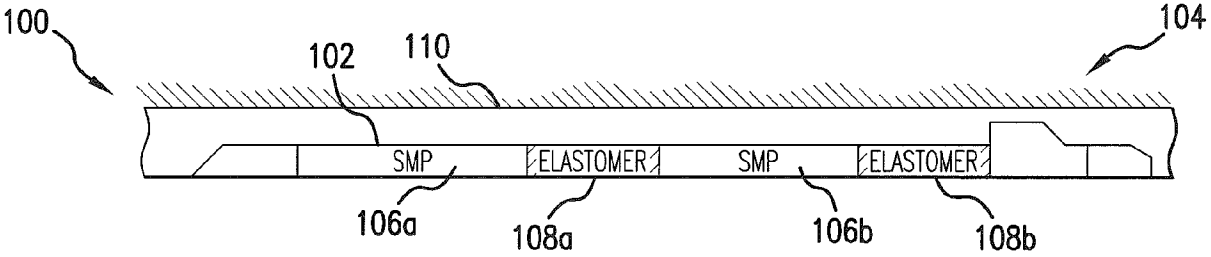
FIGS. 7A and 7B schematically show a system having a seal element formed from alternating portions of shape memory material and elastomer material.
Figure 7B:
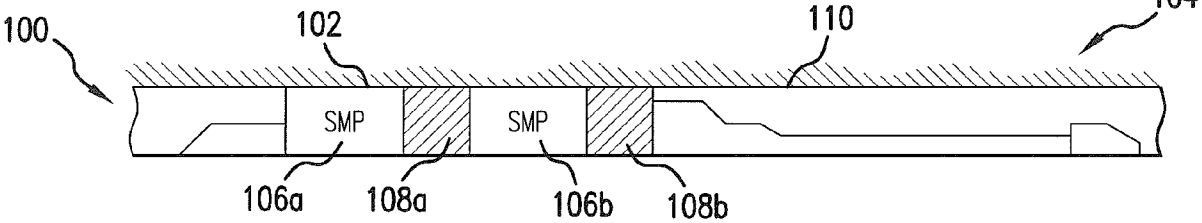

FIGS. 7A and 7B schematically show a system 100, e.g., a packer, arranged in a run-in and a set position, respectively. The system 100 has a seal element 102 and a control sub 104. The control sub 104 can take the form of any of the control subs described above, or portions or combinations thereof. The seal element 102 is formed from alternating portions or bands of two different kinds of materials, namely, a shape memory material for a first set of portions 106*a* and 106*b*, and an elastomeric material for a second set of portions 108*a* and 108*b*. Since shape memory polymers and elastomers can have different properties, particularly under different ambient conditions, this arrangement enables each type of material to act as a backup for the other while sealing against a downhole structure 110. In this way, the benefits of using both types of materials can be achieved (e.g., more reliable conformability of shape-memory materials and high temperature and pressure rating of elastomers). In one embodiment, two different shape memory materials are utilized. For example, by selecting two different shape memory materials with different transition stimuli, e.g., one shape memory material is responsive to a higher temperature than the other shape memory material, a similar result to the above can be obtained. That is, for example, a first shape memory material having a greater glass transition temperature will exhibit more elastomeric properties than a second shape memory material having a lower glass transition temperature, and thus, the first shape memory material can be used as a backup for the first shape memory material (e.g., arranged in alternating portions) and/or will more readily maintain a seal against a downhole structure at elevated temperatures, etc. As a more specific example, a first shape memory material having a glass transition temperature of about 450° F. could be used as a backup for a second shape memory material having a glass transition temperature of 400° F. (that is, with portions of the first shape memory material surrounding a portion of the second shape memory material). Of course, more than two different shape memory materials could be used having any other set of differing glass transition temperatures or other transition stimuli. Other materials having properties different than both that of elastomers and shape memory polymers could be similarly used in similar embodiments. Additionally, any number of portions of each of the two or more different materials could be used. In another example, a seal element formed from portions of more than two different types of materials could be used in any desired pattern or arrangement.

Figure 8A:
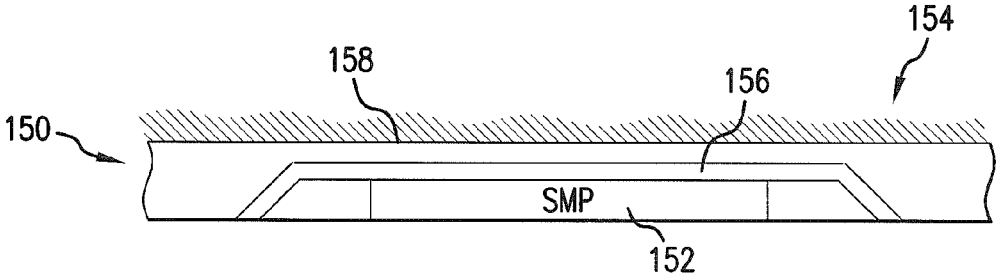
FIGS. 8A and 8B schematically show a system with a seal element having a cover layer thereon.
Figure 8B:
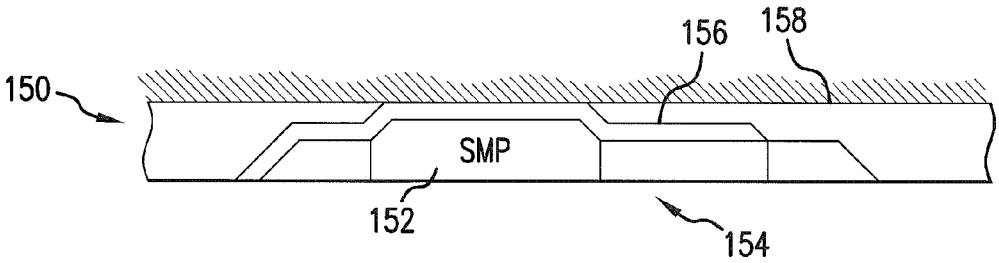

A system 150, e.g., a packer, is shown in a run-in and a set position, respectively, in FIGS. 8A and 8B. The system 150 has a seal element 152 and a control sub 154, and each can take the form of any of the control subs described above, or portions or combinations thereof. The system 150 additionally includes a protective layer, casing, cover, or coating 156 disposed on the seal element 152 and/or the control sub 154. The layer 156 in one embodiment takes the form of a mesh that is anchored around both ends of the system 150. The mesh could be stainless steel, carbon fiber material such as KEVLAR® brand synthetic material, etc. In another embodiment, the layer 156 is an elastomeric coating applied to the seal element 152 and/or the control sub 154 for protecting the system 150 during run-in. If disposed about the seal element 152, the layer 156 should be selected as a material that can stretch or deform for enabling the seal element 152 to seal against a downhole structure 158.

Figure 9A:
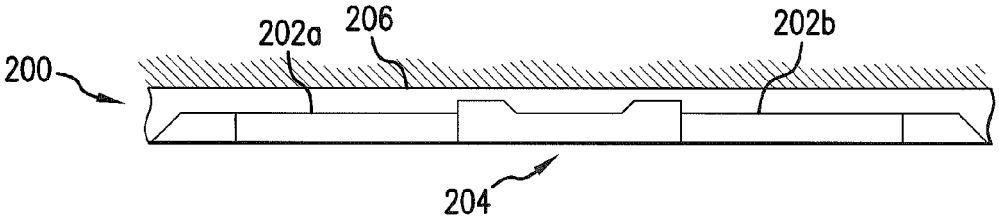
FIGS. 9A and 9B schematically show a system having a double-sided control sub for setting two seal elements.
Figure 9B:
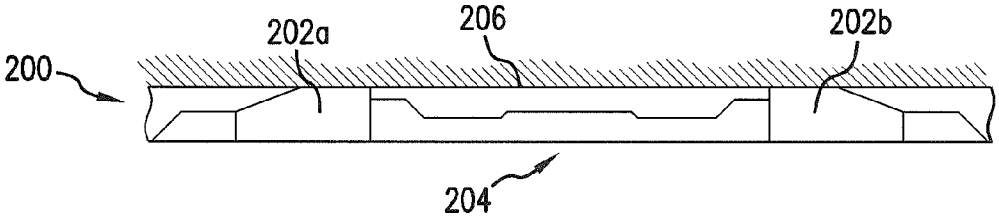

A system 200 according to another embodiment is illustrated in a run-in configuration and a set configuration, respectively, in FIGS. 9A and 9B. The system 200 includes a pair of seal elements 202*a* and 202*b* that are set by a double-sided control sub 204. The double-sided control sub 204 could, e.g., take the form of any of any two of the control subs disclosed herein, or portions or combinations thereof, with one of the control subs arranged essentially as a mirror image of the other. Of course, symmetry is not required, so long as the halves of the double-sided control sub operate in opposite directions for enabling both of the seal elements 202*a* and 202*b* to be set and sealed against a downhole structure 206. The seal elements 202*a* and 202*b* could be set simultaneously, sequentially, etc. It is also to be appreciated in view of the illustrated embodiment of FIGS. 9A and 9B that the seal elements 202*a* and 202*b* could take various shapes, e.g., the seal elements 202*a* and 202*b* are depicted as forming packer cups when set. Such a tapered or packer cup shape may be advantageous in situations where the seal element must be longitudinally stretched to a high degree, e.g., in order to achieve suitable radial compression for running the seal element into position (and/or where the difference between the radially compressed dimension and the radially expanded dimension are particularly great). That is, less volume needs to be repositioned for reverting from a radially compressed shape to the tapered shape of the seal elements 202*a* and 202*b* than would be required for seal elements of similar size having rectangular cross-sections.

In one embodiment, the shape memory material is a shape memory polymer made from cross-linked polyphenylene sulfide (PPS) and polyphenylsulfone (PPSU) as described in more detail below and in co-owned U.S. patent application Ser. No. 13/303,688 (Gerrard et al.), which Application is incorporated herein by reference in its entirety. In one embodiment the shape memory material transitions between its deformed shape and its original shape due to temperature and has a glass transition temperature in the range of about 300° F.-650° F. (about 150° C.-315° C.). At these elevated glass transition temperatures, the shape memory material advantageously undergoes significantly more volumetric expansion than thermal contraction that occurs, for example, when cooling the seal element 22 after it has transitioned between shapes (such as by injecting cold fluids downhole as described above). For example, as disclosed in U.S. Pat. No. 7,743,825 (O'Malley et al.) previously known polystyrene and other shape memory polymers, which have a glass transition temperature in the range of about 100° C., thermally contract, i.e., shrink, to unacceptable levels when cooled, making them unsuitable or undesirable for many downhole applications. Of course, shape memory materials according to the current invention having different transition temperatures, e.g., glass transition temperatures, could be utilized. For example, the polyphenylene sulfide and polyphenylsulfone shape memory material described below can be blended or tailored to have a range of glass transition temperatures, e.g., as low as about 150° F.

Described herein is a new method for the manufacture of high temperature elastomers from amorphous high temperature thermoplastics such as polyphenylene sulfide and polyphenylsulfone. These new high temperature elastomers are rigid and tough at room temperature, but behave as rubbery materials at temperatures above room temperature. The new elastomers have excellent elasticity, extrusion resistance, and integrated structural strength at high temperatures. In a particularly advantageous feature, the elastomers have improved chemical resistance under wet conditions, maintaining their excellent properties even under continuous use downhole.

The methods described herein produce an elastomer having a glass transition temperature (Tg) that is greater than room temperature but lower than the minimal application temperature (MAT) of the elastomer. Thus, the elastomers are more similar to engineering plastics (rigid and strong) below the MAT, but elastomeric above the MAT. Candidates for new high temperature elastomers are therefore not limited to those polymers within the traditional classifications of elastomer materials.

Potential materials for the manufacture of the high temperature elastomers include amorphous thermoplastic polymers that are capable of being molecularly crosslinked. Molecular chains of amorphous thermoplastic polymers behave like "random coils." After crosslinking, the coils tend to deform proportionally in response to an outside-applied force, and upon release of the outside-applied force, the coils tend to recover to their original configuration. In contrast, molecular chains of crystalline or semi-crystalline polymers are regularly aligned with each other. Outside-applied force tends to destroy molecular regularity and thus generate permanent deformation, especially when the materials are subjected to constant or high stretching/deformation. The degree of molecular crosslinking of the amorphous thermoplastic polymers can be adjusted based on the material selected and the intended use of the high temperature elastomer. In an embodiment, the degree of crosslinking is low, so as to provide optimal elasticity. If the degree of crosslinking is high, rigidity and/or brittleness of the high temperature elastomer can increase.

Accordingly, there is provided in an embodiment a thermally crosslinked product of polyphenylene sulfide and polyphenylsulfone, which is useful as a high temperature elastomer in downhole and completion applications. In an embodiment, the high temperature elastomer is manufactured by heating a powdered combination of a polyphenylene sulfide and polyphenylsulfone in the presence of a crosslinking agent to a high temperature, such as at or above the glass transition temperature (Tg) of the polyphenylene sulfide and above the activation temperature for crosslinking the two polymers. In an embodiment, the heating can be from about 300° C. to about 375° C., for example, inside an oven for at least 8 hours. The polyphenylene sulfide becomes crosslinked to the polyphenylsulfone via, for example, a vulcanization or oxidization process. The crosslinking agent can be sulfur, a peroxide, a metal oxide, or a sulfur donor agent, for example.

In an embodiment, a composition includes the crosslinked product of a polyphenylene sulfide and a polyphenylsulfone. That is, in the crosslinked product, the polyphenylene sulfide is crosslinked to the polyphenylsulfone.

The polyphenylene sulfide used for crosslinking to the polyphenylsulfone comprises repeating units of formula (1)

Formula (1)

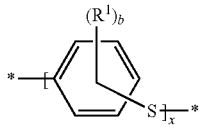

wherein

R1 is a substituent on the phenyl group, wherein each R1 is independently hydrogen, halogen, C1-C20 alkyl group, C1-C20 alkoxy group, C1-C20 haloalkyl group, C3-C20 cycloalkyl group, C2-C20 heterocycloalkyl group, C3-C20 cycloalkyloxy group, C3-C20 aryl group, C3-C20 aralkyl group, C3-C20 aryloxy group, C3-C20 aralkyloxy group, C2-C20 heteroaryl group, C2-C20 heteroaralkyl group, C2-C20 alkenyl group, C2-C20 alkynyl group, amine group, amide group, alkyleneamine group, aryleneamine group, alkenyleneamine group, nitro, cyano, carboxylic acid or a salt thereof, phosphonic acid or a salt thereof, or sulfonic acid or a salt thereof;

b is an integer from 0-4, provided that the valence of the phenyl group is not exceeded; and x is greater than about 10.

Each repeating unit can have a different or same attachment position of the sulfur atom to the phenyl ring in the repeating unit of formula (1). In addition, each unit can have a different pattern of substitution on the phenyl groups, for example a combination of units that is unsubstituted (b=0) and units that are substituted (b>0).

In a specific embodiment, the polyphenylene sulfides used for crosslinking are polyphenylene sulfides of formula (2)

Formula (2)

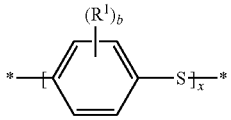

wherein each R1 is the same or different, and is as defined in formula (1), b is as defined in formula (1), and x is as defined in formula (1).

In an embodiment, each $R^1$ is the same or different, and is a linear or branched C1-C10 alkyl, linear or branched C2-C10 alkenyl, linear or branched C2-C10 alkynyl, C6-C18 aryl, C7-C20 alkylaryl, C7-C20 arylalkyl, C5-C10 cycloalkyl, C5-C20 cycloalkenyl, linear or branched C1-C10 alkylcarbonyl, C6-C18 arylcarbonyl, halogen, nitro, cyano, carboxylic acid or a salt thereof, phosphonic acid or a salt thereof, or sulfonic acid or a salt thereof.

In another embodiment each $R^1$ is the same or different, and is a linear or branched C1-C6 alkyl, C6-C12 aryl, C7-C13 alkylaryl, C7-C13 arylalkyl, linear or branched C1-C6 alkylcarbonyl, C6-C12 arylcarbonyl, C7-C13 alkyl arylenecarbonyl, C7-C13 arylalkylene carbonyl, halogen, nitro, cyano, carboxylic acid or a salt thereof, phosphonic acid or a salt thereof, or sulfonic acid or a salt thereof, and b is an integer from 0 to 4, specifically 0 to 3, 0 to 2, or 0 to 1.

In another embodiment each $R^1$ is the same or different, and is a linear or branched C1-C6 alkyl, C6-C12 arylcarbonyl, or halogen, and b is an integer from 0 to 4, specifically 0 to 3, 0 to 2, or 0 to 1.

The polyphenylene sulfides can be linked through the meta, para, or ortho positions in the backbone of the polyphenylene sulfide. In an embodiment, the polyphenylene sulfide is of formula (3)

Formula (3)

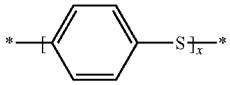

wherein x is as defined in formula (2). Here, the sulfur atom attaches to the para position of the phenyl ring, and the phenyl ring has a full complement of hydrogen atoms, i.e., $R^1$ is hydrogen, and b is 4.

The linking of the unsubstituted phenylene sulfide units can be at least 90%, at least 95%, or 99% para, with the remaining linkages being ortho or meta. In an embodiment, the polyphenylene sulfides are linked at the para positions on the unsubstituted phenylene. In a further embodiment, the polyphenylene sulfides are linked at a combination of para, ortho, and meta positions on the substituted phenylene as shown in formula (1).

The polyphenylene sulfides can be linear or branched, having 1 or more, 2 or more, or 5 or more branching points per 1,000 carbon atoms along the polymer chain. In an embodiment, the polyphenylene sulfides are linear, having 10 or fewer, 5 or fewer, 2 or fewer, or 1 or fewer branching points per 1,000 carbon atoms along the polymer chain. The thermoplastic polymer can be obtained and used in either pellet or powder form.

In an embodiment, the polyphenylene sulfides for crosslinking have a glass transition temperature (Tg) of about 70 to about 150° C. when not crosslinked to the polyphenylsulfones. The polyphenylene sulfides for crosslinking can further have a weight average molecular weight (Mw) of about 500 to about 100,000 grams/mole (g/mol), specifically about 1,000 to about 75,000 g/mol, more specifically about 1,500 to about 50,000 g/mol, and still more specifically about 2,000 to about 25,000 g/mol.

The polyphenylene sulfides for crosslinking are further characterized by relatively high tensile strength and Young's modulus (stiffness), as well as ductile mechanical deformation behavior. The polyphenylene sulfides can have a tensile yield strength of 8,000 to 25,000 psi (110 to 172 MPa), a tensile modulus of 400 to 900 KPsi (3.4 to 6.2 GPa), and a tensile elongation of 1%, 5%, 7%, 8%, or higher. The polyphenylene sulfides for crosslinking can further have a compressive strength greater than 15,000 psi (103 MPa).

A combination of different polyphenylene sulfides can be used for crosslinking, for example polyphenylene sulfides of different molecular weights, different substitution patterns, different viscosities, and/or different degrees of branching. Exemplary polyphenylene sulfides that can be used include those that are available from sources such as Chevron Phillips Chemical Company, Fortron Industries, and GE Plastics. Commercial grades of polyphenylene sulfides include those with the trade names PRIMEF®, RYTON®, FORTRON®, and SUPEC®.

In one embodiment, the polyphenylsulfone used for crosslinking to the polyphenylene sulfide comprises repeating units of formula (4)

Formula (4)

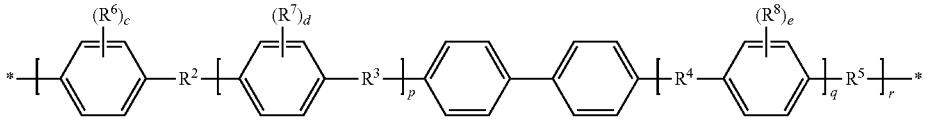

wherein each $R^2$, $R^3$, $R^4$, $R^5$ are independently —O— or —$SO_2$—, wherein at least one of $R^2$ to $R^5$ is —$SO_2$—, and at least one of $R^2$ to $R^5$ is —O—;

each $R^6$, $R^7$, and $R^8$ is a substituent on a phenyl group, and each $R^6$, $R^7$, and $R^8$ is independently hydrogen, halogen, alkyl group, alkoxy group, haloalkyl group, cycloalkyl group, heterocycloalkyl group, cycloalkyloxy group, aryl group, aralkyl group, aryloxy group, aralkyloxy group, heteroaryl group, heteroaralkyl group, alkenyl group, alkynyl group, amine group, amide group, alkyleneamine group, aryleneamine group, or alkenyleneamine group, nitro, cyano, carboxylic acid or a salt thereof, phosphonic acid or a salt thereof, or sulfonic acid or a salt thereof;

c, d, and e are integers which are each independently 0-4, provided that the valence of the phenyl group is not exceeded;

p and q are integers which are independently 0 or 1; and r is an integer which is greater than about 10.

Each repeating unit of formula (4) can have a different or same attachment position of the substituents $R^6$, $R^7$, and $R^8$ on the phenyl ring. In addition, each unit can have a different pattern of substitution on the phenyl groups, for example a combination of units that is unsubstituted (c=d=e=0) and units that are substituted (at least one of c, d, b being greater than zero).

In an embodiment, each $R^6$, $R^7$, and $R^8$ is the same or different, and is a linear or branched C1-C10 alkyl, linear or branched C2-C10 alkenyl, linear or branched C2-C10 alkynyl, C6-C18 aryl, C7-C20 alkylaryl, C7-C20 arylalkyl, C5-C10 cycloalkyl, C5-C20 cycloalkenyl, linear or branched C1-C10 alkylcarbonyl, C6-C18 arylcarbonyl, halogen, nitro, cyano, carboxylic acid or a salt thereof, phosphonic acid or a salt thereof, or sulfonic acid or a salt thereof.

In another embodiment each $R^6$, $R^7$, and $R^8$ is the same or different, and is a linear or branched C1-C6 alkyl, C6-C12 aryl, C7-C13 alkylaryl, C7-C13 arylalkyl, linear or branched C1-C6 alkylcarbonyl, C6-C12 arylcarbonyl, C7-C13 alkylarylenecarbonyl, C7-C13 arylalkylene carbonyl, halogen, nitro, cyano, carboxylic acid or a salt thereof, phosphonic acid or a salt thereof, or sulfonic acid or a salt thereof, and each c, d, and e is an integer from 0 to 4, specifically 0 to 3, 0 to 2, or 0 to 1.

In another embodiment each $R^6$, $R^7$, and $R^8$ is the same or different, and is a linear or branched C1-C6 alkyl, C6-C12 arylcarbonyl, or halogen, and each c, d, and e is an integer from 0 to 4, specifically 0 to 3, 0 to 2, or 0 to 1.

In a specific embodiment, the polyphenylsulfone used for crosslinking to the polyphenylene sulfide includes at least 50 wt. % of a first repeating unit of formula (5), based on the weight of the polyphenylsulfone Formula (5)

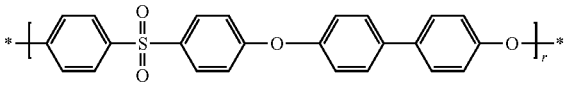

wherein r is an integer greater than about 10.

In another embodiment, the polyphenylsulfone includes a second repeating unit of formula (6), formula (7), formula (8), formula (9), or a combination thereof Formula (6)

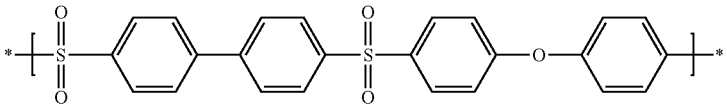

Formula (7)

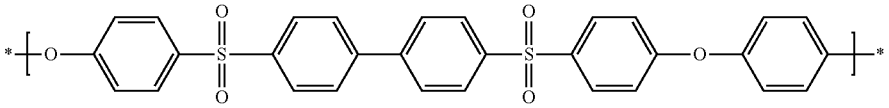

Formula (8)

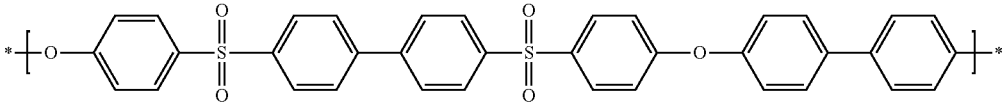

Formula (9)

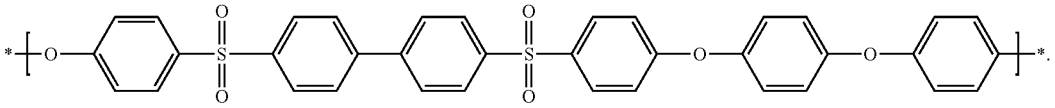

In a further embodiment, the polyphenylsulfone is a copolymer of formula (5) and formula (10), formula (11), formula (12), or a combination thereof Formula (10)

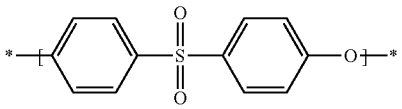

Formula (11)

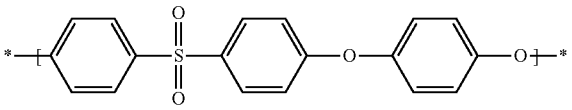

Formula (12)

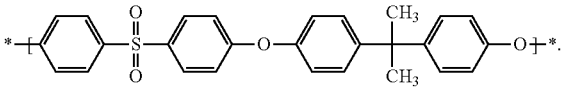

The polyphenylsulfones contain 50% or more, 85% or more, 90% or more, 95% or more, or 99% or more of the units of formula (5) based on the total number of repeat units in the polymers. Other units that can be present. According to an embodiment, the polyphenylsulfone is a copolymer of at least 50% of formula (5) and one or more of formula (6), formula (7), formula (8), formula (9), formula (10), formula (11), formula (12), or a combination thereof.

The polyphenylsulfones can be linear or branched, having 1 or more, 2 or more, or 5 or more branching points per 1,000 carbon atoms along the polymer chain. In an embodiment, the polyphenylsulfones are linear, having 10 or fewer, 5 or fewer, 2 or fewer, or 1 or fewer branching points per 1,000 carbon atoms along the polymer chain. The thermoplastic polymer can be obtained and used in either pellet or powder form.

In an embodiment, the polyphenylsulfones for crosslinking with the polyphenylene sulfides have a glass transition temperature (Tg) of greater than about 175° C. when not crosslinked to the polyphenylsulfones, specifically from about 200° C. to about 280° C., and more specifically from about 255° C. to about 275° C.

The polyphenylsulfones for crosslinking can further have a weight average molecular weight (Mw) of about 500 to about 100,000 grams/mole (g/mol), specifically about 1,000 to about 75,000 g/mol, more specifically about 1,500 to about 50,000 g/mol, and still more specifically about 2,000 to about 25,000 g/mol.

The polyphenylsulfones for crosslinking are further characterized by relatively high tensile strength and Young's modulus (stiffness), as well as ductile mechanical deformation behavior. The polyphenylsulfones can have a tensile yield strength of 10152 to 21,755 psi (70 to 150 MPa), a tensile modulus of 315 to 500 KPsi (2.2 to 3.5 GPa), and a tensile elongation of 5%, 7%, 8%, or higher. The polyphenylsulfones for crosslinking can further have a compressive strength greater than 14,350 psi (98 MPa).

A combination of different polyphenylsulfones can be used for crosslinking, for example polyphenylsulfones of different molecular weights, different substitution patterns, different viscosities, and/or different degrees of branching.

Exemplary polyphenylsulfones that can be used include those that are available from sources such as Solvay Specialty Polymers, Quadrant EPP, Centroplast Centro, Duneon, GEHR Plastics, Westlake Plastics, and Gharda Chemicals. Commercial grades of polyphenylsulfones include those with the trade names RADEL®, UDEL®, ULTRASON®, and GAFONE®.

According to an embodiment, the polyphenylene sulfide is crosslinked to the polyphenylsulfone in a method that includes heating the polyphenylene sulfide and polyphenylsulfone in presence of a crosslinking agent at a temperature and for a time effective to form the crosslinked product of polyphenylene sulfide and polyphenylsulfone. That is, the crosslinked product includes crosslinks between the polyphenylene sulfide and the polyphenylsulfone. It should be appreciated that although the process forms crosslinks between the polyphenylene sulfide and the polyphenylsulfone, that each of the polyphenylene sulfide and polyphenylsulfone can also contain crosslinks. Further, these crosslinks in either of the polymers can be present before or after the process of crosslinking together the polyphenylene sulfide and polyphenylsulfone.

In an embodiment, heating the polyphenylene sulfide and polyphenylsulfone includes increasing the temperature to greater than the melting temperature (Tm) of the polyphenylene sulfide. The temperature is increased so as to reach or surpass the activation temperature for crosslinking to occur, for example, a temperature from about 300° C. to about 400° C. After a desired degree of crosslinking is obtained, i.e., after the time effective to form the crosslinked product passes, the crosslinked product can be cooled to, for example, room temperature.

As described above, the high temperature elastomers, in particular the crosslinked polyphenylene sulfide and polyphenylsulfone, are prepared by crosslinking in the presence of a molecular crosslinking agent. Crosslinking agents include gas, solid, or liquid crosslinking agents such as peroxides, sulfur, metal oxides, or sulfur donor agents.

Peroxides can be used for crosslinking, for example organic peroxides such as ketone peroxides, diacyl peroxides, dialkyl peroxides, peroxyesters, peroxyketals, hydroperoxides, peroxydicarbonates, and peroxymonocarbonates. Examples of specific peroxides include 2,2-bis(t-butylperoxy)butane, 1,3 1,4-bis(tert-butylperoxyisopropyl)benzene, dicumyl peroxide, tert-butylcumylperoxide, 2,5-dimethyl-2,5-di-(tert-butylperoxy)hexane, n-butyl-4,4'-di(tert-butylperoxy)valerate, 1,1'-di(tert-butylperoxy)-3,3,5-trimethylcyclohexane, and the like; or inorganic peroxides such as calcium peroxide, zinc peroxide, hydrogen peroxide, peroxydisulfate salts, and the like. Commercially available peroxides include those marketed by Arkema, Inc. under the tradename DI-CUP® including, DI-CUP® dialkyl peroxide, DI-CUP® 40C dialkyl peroxide (on calcium carbonate support), DI-CUP® 40K dialkyl peroxide, DI-CUP® 40KE dialkyl peroxide; and alkyl diperoxy compounds including 2,5-dimethyl-2,5-di(t-butylperoxy)hexane and marketed by Akzo-Nobel under the tradename TRIGONOX® 101. Effective amounts of peroxides can be readily determined by one of skill in the art depending on factors such as the reactivity of the peroxide and the polyphenylene sulfide and polyphenylsulfone, the desired degree of cure, and like considerations, and can be determined without undue experimentation. For example, peroxides can be used in amounts of about 1 to about 10 parts per 100 parts by weight of the polyphenylene sulfide and polyphenylsulfone. Sulfur can also be used for crosslinking, for example, elemental sulfur, hydrogen sulfide, or sulfur donor agents. Examples of sulfur donor agents include alkyl polysulfides, thiuram disulfides, and amine polysulfides. Some non-limiting examples of suitable sulfur donor agents are 4,4'-dithiomorpholine, dithiodiphosphorodisulfides, diethyldithiophosphate polysulfide, alkyl phenol disulfide, tetramethylthiuram disulfide, 4-morpholinyl-2-benzothiazole disulfide, dipentamethylenethiuram hexasulfide, and caprolactam disulfide. Combinations of the foregoing crosslinking agents can be used.

In another embodiment, sulfur can be used in amounts of about 1 to about 10 parts per 100 parts by weight of the polyphenylene sulfide and polyphenylsulfone composition. Sulfur can also be used for crosslinking, for example elemental sulfur or hydrogen sulfide. Combinations of the foregoing crosslinking agents can be used.

According to an embodiment, the crosslinked product includes sulfur incorporated into the crosslinks in an amount from about 0.01 wt. % to about 5 wt. %, specifically about 0.05 wt. % to about 1.5 wt. %, and more specifically about 0.09 wt. % to about 1.1 wt. % based on the weight of the polyphenylene sulfide and the polyphenylsulfone.

Other agents to initiate or accelerate cure as are known in the art can also be present, for example amine accelerators, sulfonamide accelerators, and the like. Effective amounts of crosslinking agent, activators, and the like are known in the art and can be determined without undue experimentation.

Crosslinking in the presence of a peroxide, sulfur, or other molecular crosslinking agent can be carried out at ambient pressure, at a partial pressure lower than ambient, or at elevated pressures (greater than 1 atmosphere). When peroxides, sulfur, or another gas, solid, or liquid crosslinking agent is used, the agent is generally compounded with the polyphenylene sulfide and polyphenylsulfone, which are then optionally shaped and crosslinked. The crosslinking agent can be pre-dispersed in a master batch and added to the polyphenylene sulfides and polyphenylsulfones to facilitate mixing.

Crosslinking with peroxides, sulfur, or other crosslinking agents is thermally induced and, thus, is carried out at elevated temperatures for a time and at a pressure effective to achieve the desired degree of crosslinking. For example, crosslinking is carried out at about 150° C. to about 600° C. (or higher), about 200° C. to about 500° C., or more specifically about 300° C. to about 450° C. The crosslinking is conducted for a total time of about 200 hours or less, about 72 hours or less, about 48 hours or less, or about 1 to about 48 hours. In an embodiment, crosslinking is conducted at about 300° C. to about 375° C. for about 1 to about 20 hours, specifically about 2 to about 6 hours, in air atmosphere at ambient pressure. When the polyphenylene sulfide and polyphenylsulfone combination is molded prior to crosslinking, the polyphenylene sulfide and polyphenylsulfone combination may be first molded at high temperature (e.g., 200-500° C., or 300 to 450°), followed by crosslinking as described above. If the crosslinking temperature is close to or at the thermal decomposition temperature, a combination of crosslinking temperature and time is used such that during crosslinking, the crosslinked polyphenylene sulfide and polyphenylsulfone combination exhibits a weight loss of less than 10%, specifically less than 5% weight loss, and more specifically less than 1% weight loss. According to an embodiment, the crosslinking of the polyphenylene sulfide to the polyphenylsulfone is performed at a temperature greater than the Tg of the polyphenylene sulfide. In an embodiment, the crosslinking is performed at a temperature greater than the melting temperature (Tm) of the polyphenylene sulfide. In some embodiments, the crosslinking is conducted at a temperature at or above the glass transition temperature of the crosslinked product of the polyphenylene sulfide and the polyphenylsulfone and for a time effective to provide a shape memory crosslinked polyphenylene sulfide-polyphenylsulfone, which will be further described below.

According to an embodiment, the method includes foaming a combination of the polyphenylene of formula (1) and the polyphenylsulfone of formula (4) prior to crosslinking. A further embodiment of the method includes shaping the polyphenylene of formula (1) and the polyphenylsulfone of formula (4) prior to crosslinking.

The degree of crosslinking can be regulated by controlling reaction parameters such as crosslinking temperature, crosslinking time, and crosslinking environment, for example, varying the relative amounts of the polyphenylene sulfide, polyphenylsulfone, and crosslinking agent. Degree of cure can be monitored using a number of methods. Once crosslinked, these polymers do not dissolve in solvents. In an advantageous feature, solubility can be used to examine whether or not a polymer is crosslinked. Other methods that can be used to examine molecular crosslinking include Dynamic Mechanical Analysis (DMA). This method monitors and records material modulus at different temperatures. For amorphous thermoplastic polymers, the modulus drops to near zero when the temperature is increased to above the Tg. Material tends to flow at high temperature above Tg. In contrast, crosslinked polymers will maintain a rubber-like plateau having relatively high modulus at a wide temperature range above its glass transition temperature. The crosslinked polyphenylene sulfide and polyphenylsulfone can be partially crosslinked as described above.

Crosslinking can be partial, i.e., localized, or full across the mass of the polyphenylene sulfide and polyphenylsulfone. Localized cure can be achieved based on the degree of exposure of the polyphenylene sulfides and polyphenylsulfones to the crosslinking agent (e.g., sulfur) during crosslinking. For example, where the polyphenylene sulfides and polyphenylsulfones are provided as a pellet or particle, partial cure may be obtained where only the outermost, exposed surface or layer of a particle of the crosslinked polyphenylene sulfide and polyphenylsulfone is crosslinked, while the interior of the pellet or particle is uncrosslinked. The portion crosslinked, in this instance, corresponds to the diffusion depth of the crosslinking agent into the pellet or particle during cure and varies with variation in cure condition, i.e., temperature, pressure, oxygen concentration, and time.

When polyphenylene sulfides and polyphenylsulfones are cured with, for example, sulfur, the surface of such composition may be crosslinked, but the internal portion of the materials may not be crosslinked. As a result, the material may exhibit non-uniform mechanical, chemical, and physical properties. It has been discovered that addition of a small amount of an oxidant such as magnesium peroxide will result in crosslinking for molded polyphenylene sulfide-polyphenylsulfone parts. Unlike other organic or inorganic peroxides such as dicumyl peroxide, benzoyl peroxide, zinc peroxide, calcium peroxide, etc., magnesium peroxide decomposes at much higher temperature at 350° C. and releases oxygen upon decomposition. It is also discovered herein that a small amount of sulfur will also result in crosslinking for molded polyphenylene sulfide-polyphenylsulfone parts. Full cure of a pellet, particle, or molded part thus may be more readily attained where a crosslinking agent such as a peroxide or sulfur is incorporated into the polyphenylene sulfide-polyphenylsulfone composition.

In another embodiment, the polyphenylene sulfides and polyphenylsulfones are compounded with an additive prior to crosslinking and then crosslinked. "Additive" as used herein includes any compound added to the polyphenylene sulfide and polyphenylsulfone composition to adjust the properties of the crosslinked product (that is the polyphenylene sulfide crosslinked to the polyphenylsulfone), for example a blowing agent to form a foam, a filler, or processing aid, provided that the additive does not substantially adversely impact the desired properties of the crosslinked product, for example corrosion resistance at high temperature.

Fillers include reinforcing and non-reinforcing fillers. Reinforcing fillers include, for example, silica, glass fiber, carbon fiber, or carbon black, which can be added to the polymer matrix to increase strength. Non-reinforcing fillers such as polytetrafluoroethylene (PTFE), molybdenum disulfide ($MoS_2$), or graphite can be added to the polymer matrix to increase the lubrication. Nanofillers are also useful, and are reinforcing or non-reinforcing. Nanofillers, such as carbon nanotubes, nanographenes, nanoclays, polyhedral oligomeric silsesquioxane (POSS), or the like, can be incorporated into the polymer matrix to increase the strength and elongation of the material. Nanofillers can further be functionalized to include grafts or functional groups to adjust properties such as solubility, surface charge, hydrophilicity, lipophilicity, and other properties. Silica and other oxide minerals can also be added to the composition. Combinations comprising at least one of the foregoing fillers can be used.

A processing aid is a compound included to improve flow, moldability, and other properties of the crosslinked thermoplastic material. Processing aids include, for example an oligomer, a wax, a resin, a fluorocarbon, or the like. Exemplary processing aids include stearic acid and derivatives, low molecular weight polyethylene, and the like. Combinations comprising at least one of the foregoing fillers can be used.

The polyphenylene sulfides and polyphenylsulfones can be crosslinked together alone or in the presence of another polymer in order to obtain the desired properties of the crosslinked product (polyphenylene sulfide-polyphenylsulfone). However, the presence of other polymers may reduce chemical resistance. Thus, in an embodiment, no other polymer is present during crosslinking of the polyphenylene sulfides and polyphenylsulfones. If used, in order to maintain the desired properties of the crosslinked product, any amount of the additional polymers are limited, being present for example in amount of 0.01 to 20 weight percent (wt. %), 0.1 to 10 wt. %, or 1 to 5 wt. % of the total weight of the polymers present. For example, if used, aromatic thermoplastic polymers can be present, such as aromatic polyamides, polyimides, polyetherimides, polyaryletherketones (PAEK), polyetherether ketones (PEEK), polyether sulfones (PESU), polyphenylene sulfone ureas, self-reinforced polyphenylene (SRP), or the like, or combinations comprising at least one of the foregoing. Polymers containing oxygen include, for example, acetal resins (e.g., polyoxymethylene (POM)), polyester resins (e.g., poly(ethylene terephthalate) (PET), poly(butylene terephthalate) (PBT), and poly(ethylene naphthalate) (PEN)), polyarylates (PAR), poly(phenylene ether) (PPE), polycarbonate (PC), aliphatic polyketones (e.g., polyketone (PK)), poly (ether ketones) (polyetherketone (PEK), polyetherketoneketone (PEKK), and polyetherketone etherketone ketone (PEKEKK)), and acrylic resins (e.g., polymethylmethacrylate (PMMA)) can be used. The additional polymer can be linear or branched, homopolymers or copolymers, and used alone or in combination with one or more other aromatic thermoplastic polymers. Copolymers include random, alternating, graft, and block copolymers, the block copolymers having two or more blocks of different homopolymers, random copolymers, or alternating copolymers. The thermoplastic polymers can further be chemically modified to include, for example, functional groups such as halogen, alcohol, ether, ester, amide, etc. groups, or can be oxidized, hydrogenated, and the like. A reactive elastomer or fluoropolymer can be blended with the polyphenylene sulfides and polyphenylsulfones before crosslinking, and graft to the polyphenylene sulfides and polyphenylsulfones during their crosslinking to increase flexibility of the crosslinked product. Examples of reactive elastomers or fluoropolymers include polytetrafluoroethylene (PTFE), nitrile-butyl rubber (NBR), hydrogenated nitrile-butyl rubber (HNBR), high fluorine content fluoroelastomers rubbers such as those in the FKM family and marketed under the tradename VITON® fluoroelastomers (available from FKM-Industries) and perfluoroelastomers such as FFKM (also available from FKM-Industries) and marketed under the tradename KALREZ® perfluoroelastomers (available from DuPont), and VECTOR® adhesives (available from Dexco LP), organopolysiloxanes such as functionalized or unfunctionalized polydimethylsiloxanes (PDMS), tetrafluoroethylene-propylene elastomeric copolymers such as those marketed under the tradename AFLAS® and marketed by Asahi Glass Co., ethylene-propylene-diene monomer (EPDM) rubbers, polyvinylalcohol (PVA), and the like, and combinations comprising at least one of the foregoing polymers.

Prior to crosslinking, or after partial crosslinking, the polyphenylene sulfides and polyphenylsulfones can optionally be shaped to provide a preform that is then crosslinked or further crosslinked. As described in more detail below, crosslinking renders the crosslinked product insoluble in most solvents. The high glass transitions temperatures of the crosslinked product also renders it non-thermoplastic. For some applications, therefore, it is advantageous to first shape the polyphenylene sulfide and polyphenylsulfone composition into the desired article prior to crosslinking. A variety of methods can be used to shape the polyphenylene sulfide and polyphenylsulfone composition, for example, molding, casting, extruding, foaming, and the like. Accordingly, in an embodiment, an article is manufactured by optionally compounding the polyphenylene sulfide and polyphenylsulfone composition with a crosslinking agent and one or more optional additives; shaping the optionally compounded composition to form a preform; and crosslinking the polyphenylene sulfides and polyphenylsulfones to form the article.

Alternatively, the crosslinked product can be shaped after crosslinking is complete by physical means such as cutting, grinding, or machining.

The polyphenylene sulfide and polyphenylsulfone composition can also be shaped by foaming, and then crosslinked after foaming, or after the foam is further shaped, for example by casting or molding the blown foam. For example the polyphenylene sulfide and polyphenylsulfone composition can be extruded with 1 to 10 wt. % of a chemical or physical blowing agent, such as water, an inert gas (e.g., argon or nitrogen), C1-C6 hydrochlrorofluorocarbons, C1-C6 hydrocarbons (e.g., propane or butane), C1-C5 alcohols (e.g., methanol or butanol), C1-C4 ketones (e.g., acetone), and the like. A nucleating agent can be present to regulate the size and number of cells. Alternatively, particulate water-soluble salts, for example sodium chloride, potassium chloride, potassium iodide, sodium sulfate, or other salt having a high solubility in water can be used to form pores, wherein the composition containing the salts is crosslinked, and the salts are removed after crosslinking, for example by soaking and/or extracting the salts from the crosslinked product with a suitable solvent (such as water, where a water-soluble nucleating agent is used) to form pores. In an embodiment, the foams are open cell foams where the voids in the foam are in fluid communication. Alternatively a closed cell foam can be made where the cells are not in communication. In this case, some of the cells can contain fluid. Examples of the fluid include air, inert gas, sulfur-containing compounds, oxygen-containing compounds, or a combination thereof. The fluid can be from a blowing agent or entrapment of, e.g., ambient gases in the closed cells. Alternatively, foams of the crosslinked product can be shaped after crosslinking is complete by physical means such as cutting, grinding, or machining In another embodiment, the polyphenylene sulfides and polyphenylsulfones can be manufactured to form shape memory materials, i.e., having thermally activated shape memory properties wherein the material is thermally activated between an actuated and unactuated shape. In this embodiment, the shape memory crosslinked product can be manufactured by optionally compounding the polyphenylene sulfide and polyphenylsulfone composition with a crosslinking agent and one or more optional additives; compacting the optionally compounded polyphenylene sulfides and polyphenylsulfones at a low temperature (e.g., 50° C. or less, or room temperature); crosslinking the compacted composition described above to form an unactuated shape; compression molding the crosslinked product at a temperature at or above the Tg of the crosslinked product to form an actuated shape of the crosslinked product; allowing the crosslinked product having the actuated shape to cool in the mold, or de-molding at a temperature at or above the Tg of the crosslinked product and allowing the crosslinked product to cool after demolding to provide a crosslinked product having an actuated shape, i.e., after de-molding the crosslinked product maintains the actuated shape since is cooled to below the Tg of the crosslinked product more rapidly than the time it takes to convert from the actuated shape to the unactuated shape. The temperature used during crosslinking the composition and the heating at or above the Tg of the crosslinked article can be the same, such that the crosslinking and the heating can be performed in the same step. The crosslinked product has thermally activated shape memory properties in that heating to at or above the Tg of the crosslinked product causes the crosslinked product to assume an unactuated shape. It is also possible to form a shape memory foam by this method, by forming a foam prior to crosslinking. In an embodiment, the Tg of the crosslinked product is intermediate between the Tg of the polyphenylene sulfide and the polyphenylsulfone.

The crosslinked product of polyphenylene sulfide crosslinked to polyphenylsulfone has a Tg higher than the polyphenylene sulfide before crosslinking with the polyphenylsulfone, for example about 5° C. or more, about 20° C. or more, about 30° C. or more, or about 10 to about 145° C. higher than the Tg of the polyphenylene sulfide before crosslinking. Thus, the crosslinked product can have a Tg of about 105° C. or higher, about 150° C. or higher, more specifically about 180° C. or higher, up to about 240° C. Such Tgs are obtained after the polyphenylene and polyphenylsulfone composition reaches the desired degree of cure, e.g., after curing at 350° C. for at least 8 hours.

The Tg of the crosslinked product can be varied by changing the ratio of the relative amounts of the polyphenylene sulfide and polyphenylsulfone in the composition. It should be appreciated that the Tg of the crosslinked product is between the Tg of the PPS and the Tg of the PPSU for composition other than pure PPS or PPSU.

The crosslinked product (cured with, for example, 1 part sulfur at 375° C. for at about 6 hours) has a storage modulus (E') of greater than about 10 megaPascals (MPa) or more, about 100 MPa or more, still more specifically about 300 MPa or more.

The crosslinked products, for example PPS/PPSU cured, e.g., at 350° C. for at least 8 hours, can have a thermal decomposition temperature of about 450° C. or higher, up to about 550° C.

The crosslinked products have a number of advantageous properties, particularly for use in downhole applications. In an especially advantageous feature, the chemical resistance of the polyphenylene sulfides and polyphenylsulfones is improved, and at the same time, the elastomeric properties of the polyphenylene sulfides and polyphenylsulfones are maintained after crosslinking the two together. The crosslinked product can be used continuously at high temperatures and high pressures, for example, 100 to 400° C., or 200 to 400° C. under wet conditions, including highly basic and highly acidic conditions. Thus, the crosslinked products resist swelling and degradation of properties when exposed to chemical agents (e.g., water, brine, hydrocarbons, acids such as sulfuric acid, solvents such as toluene, etc.), even at elevated temperatures of up to 400° C., and at elevated pressures (greater than atmospheric pressure) or prolonged periods. Further, the crosslinked products have excellent rubbery elasticity (elastomeric properties) at high temperature, i.e., at 350° C. as determined using dynamic mechanical analysis (DMA).

The storage modulus below the Tg of the crosslinked product as well as the rigidity of its elastomeric state above its Tg can be varied by the amount of crosslinking between the PPS and PPSU, which can be controlled at least by varying the amount of crosslinking agent, for example, sulfur. In an embodiment, the storage modulus for a 50/50 PPS/PPSU crosslinked product is from about 200 MPa to about 700 MPa at 100° C. as the amount of sulfur is varied from about 0.5 to about 10 parts sulfur in the composition before crosslinking.

The Tg of the crosslinked product is variable and depends on the relative amounts of the PPS and PPSU in the crosslinked product. For example, the Tg varies from about 212° C. for a 10/90 PPS/PPSU crosslinked product to about 104° C. for a 90/10 PPS/PPSU crosslinked product.

In addition to excellent elastomeric properties at high temperatures, the crosslinked products have excellent chemical resistance. As discussed above, downhole articles such as sealing elements are used under harsh, wet conditions, including contact with corrosive water-, oil-and-water-, and oil-based downhole fluids at high temperature.

In a specific embodiment, it has been discovered that the crosslinked products of polyphenylene sulfide and polyphenylsulfone disclosed herein exhibit outstanding corrosion resistance, that is, retention of their original mechanical properties (such as elasticity, modulus, and/or integrated strength) after contact with highly corrosive downhole fluids (e.g., cesium acetate having pH=10 or alkaline brine with pH about 3) at temperatures as high as 250° C. or higher.

The crosslinked products are useful for preparing elements for downhole applications, such as a packer element, a blow out preventer element, a submersible pump motor protector bag, a sensor protector, a sucker rod, an O-ring, a T-ring, a gasket, a sucker rod seal, a pump shaft seal, a tube seal, a valve seal, a seal for an electrical component, an insulator for an electrical component, a seal for a drilling motor, a seal for a drilling bit, or porous media such as a sand filter, or other downhole elements. According to an embodiment, the crosslinked product is used in sealing elements for High Temperature High Pressure (HTHP) or Ultra High Temperature High Pressure (UHTHP) applications since the crosslinked product has high thermal stability and a high decomposition temperature.

In an embodiment, a downhole seal, e.g., a packer element, includes a crosslinked product of PPS/PPSU as described above. In an embodiment, the downhole seal is made by molding a crosslinked product to form a preform; and crosslinking the preform to form the downhole seal.

In a specific embodiment the article, for example the downhole seal, can be a shape memory seal manufactured using the methods described above, for example by compression molding the PPS and PPSU, optionally compounded with a crosslinking agent or an additive; heating at a temperature that is at or above the Tg of the crosslinked product and that is effective to crosslink the PPS to the PPSU; and demolding the seal at a temperature at or above the Tg of the crosslinked product to provide the shape memory seal having a first shape. In use, the seal is first installed at low temperature (e.g., at room temperature or below the Tg of the crosslinked product) and thus having its first shape; downhole, the seal is exposed to temperatures at or above the Tg of the crosslinked product, and thus assumes a second shape, for example a shape that effectively seals or occludes. Of course, other shape memory articles for downhole use can also be manufactured using this general method.

Alternatively, the elements can be manufactured from the crosslinked product by preparing the crosslinked product in particle or bulk form; comminuting the bulk form to particulates; optionally compounding the particulates with an additive; and forming the element from the compounded particulates, for example by molding, extrusion, or other methods. Comminuting the bulk crosslinked product of PPS/PPSU can be by any method, for example use of a mortar and pestle, ball mill, grinder, or the like, provided that the particle size of the resultant polymer is suitable for adequate mixing. The particle size is not particularly limited, for example the crosslinked product is produced or comminuted to a particle size of about 10 mesh or less, about 20 mesh or less, or about 40 mesh or less. The particles can be compounded with additional crosslinking agents, any of the additives described above, or other additives ordinarily used for the intended element.

In a specific embodiment, particles are used to form shape memory articles. In this process, a shape memory article is manufactured by preparing the crosslinked product of PPS/PPSU prepared in particle or bulk form; comminuting the bulk form to provide particulates; optionally compounding the particulates with an additive; compression molding the optionally compounded particulates at a temperature at or above the Tg of the crosslinked product (for example, greater than about 180° C., or about 200 to about 300° C.) to form the article; and cooling the article in the mold or removing the article from the mold at or above the Tg of the crosslinked product and allowing it to cool.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A sealing assembly comprising:

a seal element at least partially formed from a shape memory material, the shape memory material urging the seal element to revert to an original shape upon exposure to a transition stimulus, the seal element operatively arranged for sealing against a downhole structure when in the original shape; and a mechanical interlock mechanism for holding the seal element in a deformed position in which the seal element is not able to seal against the downhole structure even after exposure to the transition stimulus, the interlock mechanism being actuated independently of seal element energy.

2. The sealing assembly of claim 1, wherein the original shape defines a first radial dimension for the seal element that is greater than a second radial dimension defined by the deformed shape.

3. The sealing assembly of claim 1, further comprising a timer device for releasing the interlock mechanism at a desired time.

4. The sealing assembly of claim 3, wherein the timer device releases the interlock mechanism after a preset amount of time has elapsed.

5. The sealing assembly of claim 3, wherein the timer device includes a sensor and releases the interlock mechanism upon detection of a predetermined downhole condition or parameter.

6. The sealing assembly of claim 1, wherein the interlock is released by shifting a sleeve.

7. The sealing assembly of claim 1, wherein the interlock device is released by shifting one or more dogs radially.

8. The sealing assembly of claim 1, wherein the interlock includes a component that is degradable upon exposure to a downhole fluid and released by degrading the component.

9. The sealing assembly of claim 1, further comprising an actuator for assisting in transition of the seal element from the deformed shape to the original shape after release of the interlock.

10. The sealing assembly of claim 9, wherein the actuator comprises a piston.

11. The sealing assembly of claim 10, wherein a fluid pressure sub is included for actuating the piston when the interlock is released.

12. The sealing assembly of claim 1, further comprising a ratcheting device for maintaining a set condition of the seal element during or after transition from the deformed shape to the original shape.

13. The sealing assembly of claim 1, wherein the transition stimulus related to raising a temperature of the seal element above a transition temperature of the shape memory material.

14. The sealing assembly of claim 13, wherein the seal element is operatively arranged for maintaining sealed against the downhole structure after the temperature has been cooled back below the transition temperature of the shape memory material.

15. The sealing assembly of claim 1, wherein the seal element comprises a second material in addition to the shape memory material.

16. The sealing assembly of claim 15, wherein the shape memory material and the second material are arranged in alternating portions or bands.

17. The sealing assembly of claim 16, wherein the second material is operatively arranged as a backup for the shape memory material.

18. The sealing assembly of claim 16, wherein the second material is elastomeric.

19. The sealing assembly of claim 16, wherein the second material is a second shape memory material responsive to a second transition stimulus.

20. The sealing assembly of claim 19, wherein the transition stimulus relates to a first temperature, the second transition stimulus relates to a second temperature greater than the first temperature, and a difference between the first temperature and the second temperature enables the second shape memory material to exhibit different properties than the shape memory material in response to downhole conditions.

21. The sealing assembly of claim 15, wherein the other material is disposed as a cover or layer on the shape memory material.

22. The sealing assembly of claim 1, wherein the shape memory material is a cross-linked product of polyphenylene sulfide and a polyphenylsulfone.

23. The sealing assembly of claim 1, wherein the shape memory material has a glass transition temperature between about 300° F. and 650° F.

24. The sealing assembly of claim 1, wherein a force generated by the shape memory material is solely responsible for the reverting the seal element to the original shape and sealing against the downhole structure.

25. A method of setting a downhole sealing assembly comprising:

positioning a seal element in a borehole, the seal element having a deformed shape during positioning of the seal element and formed at least partially from a shape memory material for urging the seal element to an original shape upon exposure to a transition stimulus;

exposing the seal element to the transition stimulus for urging the shape memory material to revert the seal element to the original shape;

preventing a transition of the seal element from the deformed shape to the original shape with a mechanical interlock coupled to the seal element; and releasing the interlock independent of seal element energy for enabling the seal element to return to its original shape.

26. The method of claim 25, further comprising performing a downhole operations requiring fluid communication between opposing sides of the seal element before releasing the interlock.

27. The method of claim 25, wherein exposing the seal element to the transition stimulus includes submitting the seal element to a temperature greater than a transition temperature of the shape memory material.

28. The method of claim 25, further comprising sealing the seal element against a downhole structure after the interlock is released.

29. The method of claim 28, further comprising removing the transition stimulus from the seal element after the seal element has been sealed against the downhole structure for hardening the seal element.

30. The method of claim 29, wherein removing the transition stimulus includes cooling the seal element.

31. The method of claim 28, wherein sealing the seal element against the downhole structure is achieved solely by a force generated by the shape memory to return the seal element to the original shape.

32. The method of claim 25, wherein the shape memory material is a cross-linked product of a polyphenylene sulfide and a polyphenylsulfone.

33. The method of claim 25, wherein the seal element comprises another material in addition to the shape memory material.

34. The method of claim 33, wherein the other material and the shape memory material are disposed as alternating portions.

35. The method of claim 33, wherein the other material is a second shape memory material responsive to a second transition stimulus and having properties different than that of the shape memory material.

* * * * *